US008840437B2

(12) United States Patent
Hentschel et al.

(10) Patent No.: US 8,840,437 B2
(45) Date of Patent: Sep. 23, 2014

(54) PRODUCTION OF AN ELECTRICAL CABLE AND METHOD FOR PRODUCING A CONNECTION

(75) Inventors: Wolfgang Hentschel, Schopfheim (DE); Franz-Josef Lietz, Oberhausen-Lirich (DE); Rudolf Trefzger, Wehr/Baden (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 0 days.

(21) Appl. No.: 13/698,071

(22) PCT Filed: Feb. 15, 2012

(86) PCT No.: PCT/EP2012/052578

§ 371 (c)(1),
(2), (4) Date: Nov. 15, 2012

(87) PCT Pub. No.: WO2012/139793

PCT Pub. Date: Oct. 18, 2012

(65) Prior Publication Data

US 2013/0059473 A1 Mar. 7, 2013

(30) Foreign Application Priority Data

Apr. 14, 2011 (DE) ..... 10 2011 017 070

(51) Int. Cl.

| | |
|---|---|
| ***H01R 4/02*** | (2006.01) |
| *H01R 11/12* | (2006.01) |
| *H01R 11/28* | (2006.01) |
| *H01R 4/62* | (2006.01) |

(52) U.S. Cl.

CPC ..... *H01R 4/029* (2013.01); *H01R 11/12* (2013.01); *H01R 2201/26* (2013.01); *H01R 11/281* (2013.01); *H01R 4/62* (2013.01)

USPC ..... 439/874

(58) Field of Classification Search

USPC ..... 439/874

See application file for complete search history.

(56) References Cited

U.S. PATENT DOCUMENTS

| | | | | |
|---|---|---|---|---|
| 3,656,092 | A * | 4/1972 | Swengel et al. | 439/730 |
| 3,728,781 | A | 4/1973 | Curtis et al. | 29/470.3 |

(Continued)

FOREIGN PATENT DOCUMENTS

| | | | |
|---|---|---|---|
| DE | 2249707 | 4/1973 | H01R 5/04 |
| DE | 2938133 | 9/1979 | H01R 17/014 |

(Continued)

OTHER PUBLICATIONS

International Searching Authority International Search Report—International Application No. PCT/EP2012/052578, dated Apr. 24, 2012, 4 pages.

(Continued)

*Primary Examiner* — Gary Paumen

(74) *Attorney, Agent, or Firm* — Sunstein Kann Murphy & Timbers LLP

(57) ABSTRACT

Connection of an electrical cable consisting of a plurality of wires or strands to a terminal, in particular for the electrical system of a motor vehicle, having a support sleeve which encloses an end area of the cable and serves to accommodate an end face of the cable, so that the wires or strands are held in the support sleeve, wherein the face side of the cable consisting of the individual wires or strands is welded to the terminal by means of an at least face side weld seam. A particularly simple connection is then possible if the terminal is hollow on the side opposite the weld seam.

16 Claims, 4 Drawing Sheets

(56) References Cited

U.S. PATENT DOCUMENTS

| | | | | |
|---|---|---|---|---|
| 4,196,960 | A * | 4/1980 | Gelfand | 439/874 |
| 4,317,277 | A * | 3/1982 | Bennett et al. | 29/860 |
| 4,394,533 | A * | 7/1983 | Naito | 174/74 R |
| 4,553,809 | A | 11/1985 | Holt | 339/275 T |
| 4,846,736 | A * | 7/1989 | Powers et al. | 439/738 |
| 6,293,594 | B1 * | 9/2001 | Safarevich et al. | 285/21.1 |
| 6,538,203 | B1 | 3/2003 | Nölle et al. | 174/84 R |
| 7,374,466 | B2 * | 5/2008 | Onuma et al. | 439/874 |
| 7,828,610 | B2 * | 11/2010 | Lehmann et al. | 439/874 |
| 8,442,658 | B2 * | 5/2013 | Li | 607/122 |

FOREIGN PATENT DOCUMENTS

| | | | |
|---|---|---|---|
| DE | 10200503024 | 8/2006 | H01R 43/02 |
| DE | 102005030248 | 8/2006 | H01R 43/02 |
| EP | 1032077 | 8/2000 | H01R 4/62 |
| EP | 2131448 | 12/2009 | H01R 4/62 |
| GB | 1213922 | 11/1970 | H01R 4/62 |

OTHER PUBLICATIONS

European Patent Office Netherlands Office Action, Application No. 12705269.4-1801, dated Mar. 11, 2014, 5 pages.

* cited by examiner

PRODUCTION OF AN ELECTRICAL CABLE AND METHOD FOR PRODUCING A CONNECTION

The subject matter of the invention relates to the connection of an electrical cable consisting of a plurality of wires or strands to a terminal, in particular for the electrical system of a motor vehicle, having a support sleeve. The support sleeve is formed to accommodate an end area of the cable and encloses it. The wires or strands are hereby held in the support sleeve, wherein the face side of the cable consisting of the individual wires or strands is welded to the terminal by means of an at least face side weld seam.

Connecting electrical cables to terminals is particularly commonplace in the automotive industry. However, the pressure on cost is enormous, so that the components suppliers are constantly looking for connection technologies which are durable and reliable in terms of the process but which at the same time can be applied cost-effectively.

A connection of an aluminium cable to a terminal, which can be composed of copper, is known from the European patent specification EP 1 032 077 B1, for example. Here, it is described that the end of the aluminium cable, in particular the end of the aluminium cable where the insulation has been removed, is pressed by means of a sleeve, so that the strands of the cable are pressed together. The end of the cable pressed in this way is connected to a terminal by a friction welding process.

The technology described in the above patent was a breakthrough in connecting aluminium cables to terminals, since for the first time it was possible to connect aluminium to other join partners, in particular copper or brass, in a way which was durable and reliable in terms of the process. The sleeve ensures that the strands of the aluminium cable do not fan out during the welding process. It is hereby ensured that a good intermetallic connection is formed between the face sides of the strands and the terminal. This is an important prerequisite for a permanent, good electrically conducting connection.

The disadvantage of the method described in the European patent specification mentioned, however, is that the terminal consists of a whole material. On the one hand, this is heavy and therefore not appropriate nowadays in the context of the required reduction in weight in vehicle construction and, on the other hand, such a terminal is expensive, since a substantial amount of material is used. Finally, the production of the terminal is also elaborate, since it usually has to be provided as a forged piece, which is expensive in terms of production.

For this reason, the object of the subject matter of the invention was to provide a connection of a cable to a terminal which, on the one hand, would be reliable in terms of the process but, on the other hand, would enable savings on material and weight to be made.

This object is achieved by a connection according to claim 1. It is, in particular, proposed that the terminal is hollow on the side opposite the weld seam.

The terminal is preferably formed from a metal sheet or strip which has a contact surface/connecting surface facing the support sleeve and the end area of the cable. Due to the fact that the terminal is hollow on the side opposite the weld seam, savings on weight and material can be made. The terminal can at one end provide a crimp lug, a bore, a bolt, a screwed connection or similar, via which the connection to a copper cable is made possible. On the side facing the cable, the terminal has a preferably circular connecting surface which is preferably flat. The cable together with the support sleeve can be connected to this connecting surface and welded to it. Both the connecting surface and the cable preferably have circular cross-sections, but other cross-sections are also possible and within the scope of that which is claimed with regard to the subject matter of the invention.

Hollow in terms of the subject matter of the invention is to be understood to the effect that a space delimited by walls is formed on the side opposite the weld seam. This space can be open on one side, but can also be fully closed. Preferably, hollow means that an at least partly circumferential wall is provided along the circumference of the weld seam.

An end area of the cable is in particular the area of the cable which has the insulation removed. The face side of the cable is preferably formed by the ends of the wires or strands.

The cable has preferably been cut or cut through in such a way that a face side of the cable is formed which is as flat as possible. Hence, the strands preferably end on a plane, wherein here a tolerance range of +/−1 to 2 mm is possible.

It is particularly advantageous if the terminal is tubular. In this case, the terminal has a bottom which forms the connecting surface for the weld seam. The bottom is welded to the cable along the weld seam. It is also possible for the weld seam to extend beyond the cable to the support sleeve. In this case, the connecting surface is welded to the support sleeve as well as to the face side of the wires or strands.

According to one advantageous exemplary embodiment, it is proposed that the bottom is formed as one piece from the walls of the terminal. In this case, it can be arranged for a tubular terminal to be initially formed. Subsequently, the ends of the tube are bent in the direction of the centre of the tubular terminal in such a way that the bottom is formed. It is also possible for the bottom to be formed from a cover arranged on the end of the terminal tube. Thus, the bottom and the terminal can either be formed as one piece or the bottom and the terminal can be formed as two pieces.

The cover is preferably pushed into the tube or fitted onto the tube. The cover is preferably pressed in the tube. Here, the cover can have a cross-section which is stepped such that a first diameter corresponds to the inner diameter of the terminal and a second diameter at least corresponds to the outer diameter of the terminal but is at least greater than the inner diameter. Then, the first diameter of the cover can be pushed into the tube of the terminal, wherein the second diameter abuts on the end face of the tube. The cover can be subsequently pressed in the tube. It is also possible for the cover to be welded to the tube. Finally, it is also possible for the cover to be soldered or bonded to the tube. Other connection technologies are also possible, as long as an electrical connection is obtained between the cover and the terminal. The surface of the cover facing away from the tube then forms the connecting surface.

According to one advantageous exemplary embodiment, it is proposed that the wall of the terminal is deformed at its end forming the bottom. As already mentioned, the wall of the terminal is bent inwards, in particular in the area of the face side end. The wall is preferably bent towards the centre of the tubular terminal.

According to one advantageous exemplary embodiment, it is also proposed that the terminal is a drawn, in particular a deep-drawn, cup in the bottom area. The terminal can, for example, be a flat part which in a drawing process is formed in such a way that at least on the end side it forms a tubular, U-shaped terminal open on one side. The face of the cup pointing outwards serves as the connecting surface for the weld seam. A terminal can be formed in a particularly cost-effective way by means of the method described.

As already mentioned, the terminal can be formed from a flat part. The flat part can then, for example in a first process step, be stamped from a metal sheet or strip which has the required contact arrangements. Subsequently, the flat part can be deformed and in particular can be bent to a tubular shape at the end, and in doing so the bottom can be created. Finally, the terminal, in terms of the subject matter of the invention, is then formed from the flat part.

According to one advantageous exemplary embodiment, it is proposed that in the deformed state of the flat part the end faces turned towards one another are connected to one another in a form-fit fashion, and in particular engage with one another from behind in a dovetail fashion. In a contact arrangement, an area of the flat part can, for example, be rectangular. The opposing end faces of the flat part can have projections and recesses which correspond to one another, in particular dovetail-shaped projections and recesses. If the flat part is then bent into a tube, the end faces, initially situated opposite one another, are turned towards one another. It is proposed that the end faces which are then turned towards one another engage with one another from behind and are preferably intertwined, so that the tube formed retains its shape. Here, it has been shown that the dovetail enables a particularly favourable form-fit connection to be produced. However, the end faces can also be soldered or welded.

According to one advantageous exemplary embodiment, it is proposed that a circular extension is formed on one end of the flat part, this circular extension forming the bottom in the deformed state.

As previously explained, the flat part can be rectangular in a first area in a contact arrangement. This area can be deformed into a tubular shape. A circular extension can be arranged on the rectangle, on a long face side, to then form the bottom. Thus, the flat part can be formed, for example by stamping, in such a way that both the rectangle and the extension are directly stamped from one metal sheet. The extension can be bent after the tube has been formed, so that it rests or abuts on the face side of the tube. It can subsequently be welded, soldered or bonded to the face side of the tube.

The terminal can be formed particularly cost-effectively if it is a tube cable lug. A tube cable lug can be obtained particularly cheaply as a bulk commodity. To form the terminal according to the subject matter of the invention, it is only necessary to deform the face side ends of the open area of the tube cable lug into a bottom or arrange a cover on it.

The connection between the support sleeve, the cable and the terminal is advantageously accomplished via the weld seam. This advantageously is a friction weld seam, a rotational friction weld seam, a resistance weld seam, a laser weld seam or an ultrasonic weld seam. These welding methods are all suitable for connecting a cable to a terminal. These methods are particularly suitable for connecting a cable to a terminal. These methods are particularly suitable for connecting a cable consisting of aluminium or an aluminium alloy to a terminal consisting of a non-iron metal, in particular copper, in particular a copper alloy. However, the terminal can likewise consist of aluminium. The terminal advantageously consists of a material which can be worked and which is conductive, for example brass.

A particularly good weld seam can be obtained by the face side of the cable being flush with one end of the support sleeve. In this case, during welding not only can the face side of the cable, or the face sides of the wires or strands, be connected to the terminal, but also, at the same time, the face side of the support sleeve.

As already explained, the cable can consist of aluminium or an aluminium alloy. Furthermore, the terminal can consist of a conductive material which can preferably be worked. Here, non-iron metals, such as for example copper or copper alloys, like for example brass or bronze, are particularly suitable.

It is also proposed that the cable has the insulation removed in the area of the support sleeve. In this case, the bared area of the cable or the bared end of the cable is inserted into the support sleeve and can then be pressed with the support sleeve. The support sleeve can be slit for this purpose, so that during pressing the slit is closed and the diameter of the support sleeve is reduced. Pressing the strands is hereby made easier.

The subject matter of the invention is explained in more detail below with the aid of the figures which show exemplary embodiments.

Figure 3A:
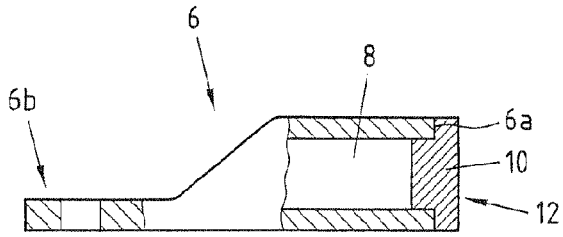
Figure 3B:
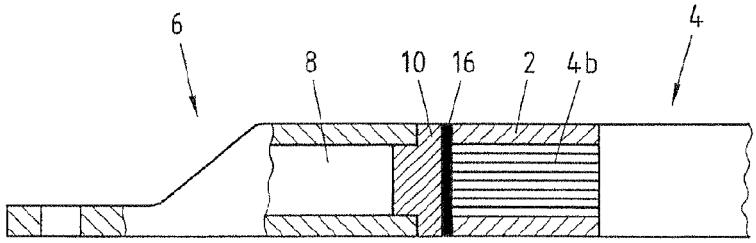
Figure 3C:
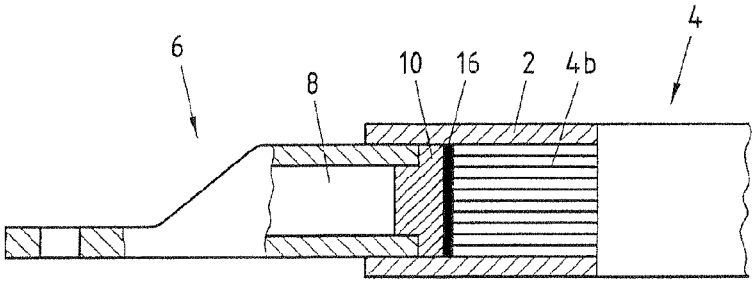
Figure 4A:
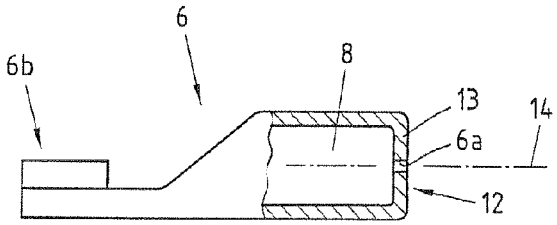
Figure 4B:
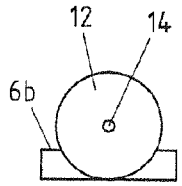
Figure 4C:
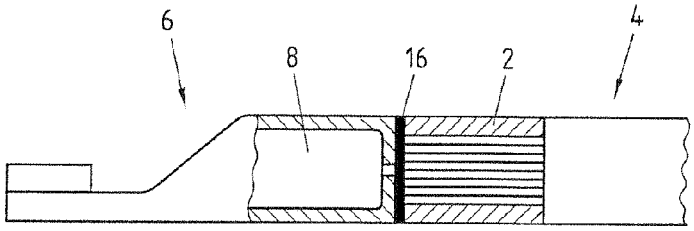
Figure 4D:
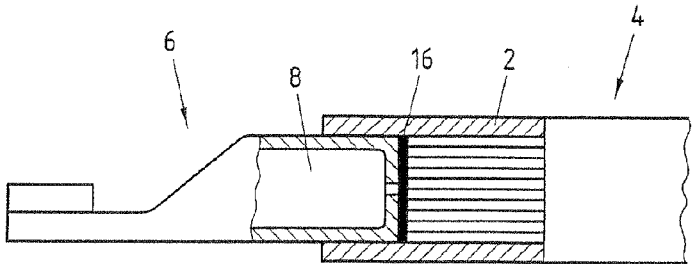
Figure 5:
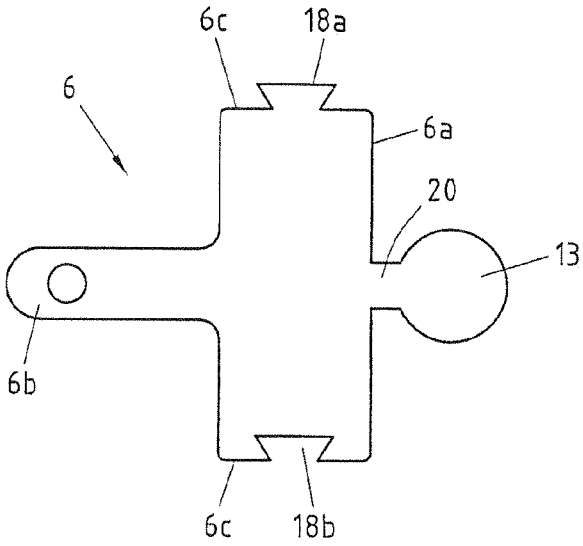
Figure 6:
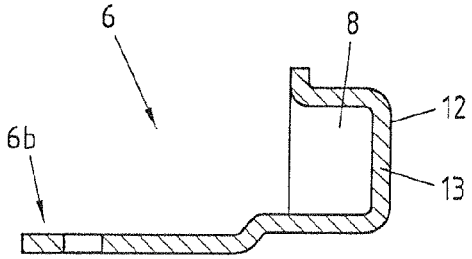

FIG. 3*a* shows a sectional view of a terminal according to an exemplary embodiment;

FIG. 3*b* shows a sectional view of a terminal connected to a cable;

FIG. 3*c* shows a further sectional view of a terminal connected to a cable;

FIG. 4*a* shows a sectional view of a further exemplary embodiment of a terminal;

FIG. 4*b* shows a side view of a terminal according to an exemplary embodiment;

FIG. 4*c* shows a sectional view of a terminal connected to a cable;

FIG. 4*d* shows a further sectional view of a terminal connected to a cable;

FIG. 5 shows a contact arrangement of a terminal;

FIG. 6 shows a further view of an exemplary embodiment of a terminal.

Figure 1:
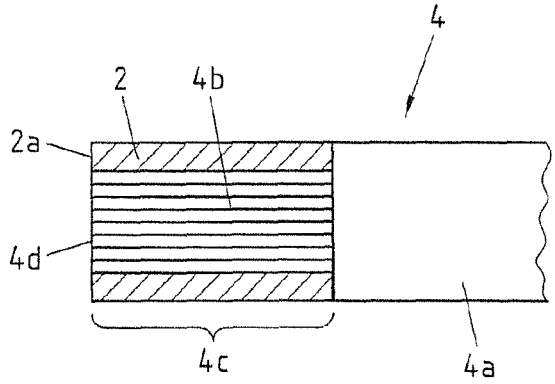
FIG. 1 shows a sectional view of a cable with a support sleeve.

FIG. 1 shows a support sleeve 2 in a sectional view. The support sleeve 2 is preferably round and consists of aluminium, copper or alloys thereof. In addition, an electrical cable 4, in particular a battery cable of a motor vehicle, in particular for connecting a battery to a starter or a generator, as well as another electrical cable of a motor vehicle, are shown in FIG. 1. As can be identified, the cable 4 is covered by an insulation material 4*a*. The cable 4 is free of the insulation material 4*a* in an end area 4*c*, so that the strands 4*b* of the cable 4 are exposed.

The exposed strands 4*b* of the cable 4 are inserted into the support sleeve 2. It can be identified that the face side 2*a* of the support sleeve 2 is flush with the face side end 4*d* of the cable 4.

The support sleeve 2 is preferably pressed, so that the strands 4*b* lie close together inside the support sleeve 2.

Figure 2:
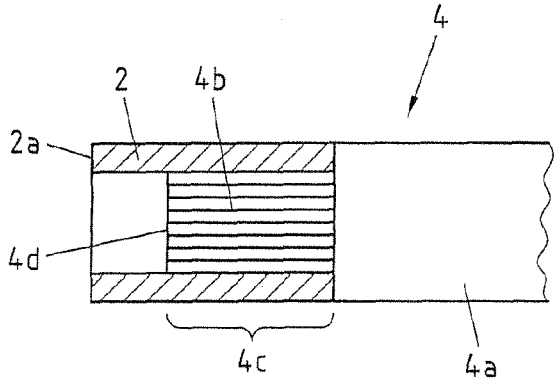
FIG. 2 shows a further sectional view of a cable with a support sleeve.

FIG. 2 shows a further exemplary embodiment of a connection of a support sleeve 2 to a cable 4. It can be identified in FIG. 2 that the end area 4*c* does not fully fill the support sleeve 2. Here, the face side end 4*d* of the strands 4*b* is inside the sleeve 2, so that they are not flush with the face side 2*a* of the support sleeve 2. Both the arrangement according to FIG. 1 and the arrangement according to FIG. 2 are suitable for connecting to a terminal, as claimed.

FIG. 3*a* shows a terminal 6. The terminal shown in FIG. 3*a* is a tube cable lug which is open at one end 6*a* and at the other end 6*b*, for example, is pressed. At the end 6*b* a bore is, for example, provided for the connection of a cable. The terminal 6 is preferably formed from copper or a copper alloy.

It can also be identified in FIG. 3*a* that the terminal 6 has a hollow space 8. The hollow space 8 is formed by the tubular end of the terminal 6 and closed by a cover 10. As can be identified, the cover 10 has two diameters. A first, smaller diameter is pushed into the hollow space 8 and a second diameter, which is greater than the first diameter, abuts on the end 6*a* of the terminal 6.

In the example shown in FIG. 3*a*, the cover 10 is inserted into the hollow space 8 of the terminal 6 and is welded on its face side end 6*a* to the terminal 6. However, the cover 10 can also merely be fitted onto the face side end 6*a* of the terminal 6 without being inserted into the hollow space 8.

In any event, the cover 10 provides a preferably flat connecting surface 12 to connect electrically to the face side end 4*d* of the strands.

FIG. 3*b* shows a connection between a terminal 6 and a cable 4. It can be identified that a weld seam 16 connects the connecting surface 12 to the face side 2*a* of the support sleeve 2 as well as to the face sides 4*d* of the strands 4*b*. The weld seam 16 was produced by means of a friction welding process. However, it is also possible for the weld seam 16 to be produced by means of a laser welding process, an ultrasonic welding process, a resistance welding process or another welding process.

It can also be identified in FIG. 3*b* that the hollow space 8 is on the side of the cover 10 opposite the weld seam 16, so that the terminal 6 opposite the weld seam 16 is hollow. This produces weight advantages, since the terminal 6 does not have to be formed from a whole material. Since less material is used, there are also lower material costs.

FIG. 3*c* shows a further exemplary embodiment, in which the cable 4 and the support sleeve 2, as illustrated in FIG. 2, are connected to one another. To produce an electrical connection, the cover 10 is inserted together with the end area of the terminal 6 into the support sleeve 2 and the weld seam 16 is formed at least between the connecting surface 12 and the face sides 4*d* of the strands 4*b*. With a resistance welding process, the weld seam 16 would also be formed along the outer lateral area of the terminal 6 and the inner lateral area of the sleeve 2.

FIG. 4*a* shows a further exemplary embodiment, in which the connecting surface 12 is formed from the walls of the terminal 6. The walls of the terminal 6 are bent inwards at their end areas in such a way that they point in the direction of the centre axis 14. The ends 6*a* are preferably pointing towards one another and are possibly welded to one another. The bent walls of the terminal 6 form a bottom 13 with the connecting surface 12.

A side view is shown in FIG. 4*b*. The connecting surface 12 with a circular cross-section can be identified. Other cross-sections, however, are also possible. In addition, the centre axis 14 can be identified, towards which the ends 6*a* of the terminal 6 point.

FIG. 4*c* shows a possible connection of the terminal 6 to the cable 4. Here, the weld seam 16 is formed along the face side 2*a* and the face sides 4*d* of the strands 4*b* with the connecting surface 12. Here too, the weld seam 16 is opposite the hollow space 8.

FIG. 4*d* shows a further exemplary embodiment, in which the terminal 6 is inserted with its end into the support sleeve 2*a*. Here too, a weld seam 16 can be formed at least between the connecting surface 12 and the face sides 4*d* of the strands 4*b*.

FIG. 5 shows a contact arrangement of a further embodiment of a terminal 6. Firstly, it should be noted that the terminal 6 can be formed from a metal sheet or strip. Preferably, the sheet thickness is between 1 and 10 mm. The terminal 6, as shown in FIG. 5, can be stamped from a metal sheet. It can be identified that a first palm is provided in the area of the end 6*b*. A substantially rectangular area adjoins this palm. The side facing away from the palm in the complete state forms the end 6*a* of the terminal 6. The ends 6*c* along the short edges have dovetail-shaped recesses or projections 18*a*, 18*b*. A substantially circular extension adjoins the rectangular section, this extension when incorporated forming the bottom 13. The extension is joined to the rectangular part via a bridge 20. To produce a terminal 6, in a first process step the rectangular part is deformed into a substantially circular shape. The recess 18*b* engages with the projection 18*a*, whereby the ends 6*c* are connected to one another in a form-fit fashion. Then, the bridge 20 bent, so that the bottom 13 closes the end 6*a* and a hollow space 8 is formed.

FIG. 6 shows a further exemplary embodiment, in which a flat part is bent in such a way that a cup is formed which has a hollow space 8 with a bottom 13, as illustrated. Such a form is also advantageous, since it can be easily produced.

The invention claimed is:

1. Connection of an electrical cable consisting of a plurality of wires or strands to a terminal, in particular for the electrical system of a motor vehicle, said connection comprising:

a support sleeve which encloses an end area of the cable and serves to accommodate an end face of the cable, so that the wires or strands are held in the support sleeve, wherein the face side of the cable formed by the individual wires or strands is welded to the terminal by means of an at least face side weld seam, and the terminal is hollow on the side opposite the weld seam, wherein the terminal is tubular with a bottom, and in that the bottom is welded to the cable along the weld seam, the bottom is formed from a cover arranged on the end of the terminal tube and the cover is pressed, welded or soldered in or onto the tube.

2. Connection of claim 1, wherein the terminal is a tube cable lug.

3. Connection of claim 1, wherein the weld seam is a friction weld seam, a rotational friction weld seam, a resistance weld seam, a laser weld seam or an ultrasonic weld seam.

4. Connection of claim 1, wherein the face side of the cable is flush with one end of the support sleeve.

5. Connection of claim 1, wherein the cable consists of aluminum or an aluminum alloy, and in that the terminal consists of a conductive material, in particular copper or a copper alloy.

6. Connection of claim 1, wherein the cable has insulation removed in the area of the support sleeve.

7. Connection of an electrical cable consisting of a plurality of wires or strands to a terminal, in particular for the electrical system of a motor vehicle, said connection comprising:

a support sleeve which encloses an end area of the cable and serves to accommodate an end face of the cable, so that the wires or strands are held in the support sleeve, wherein the face side of the cable formed by the individual wires or strands is welded to the terminal by means of an at least face side weld seam, and the terminal is hollow on the side opposite the weld seam, wherein the terminal is tubular with a bottom, and in that the bottom is welded to the cable along the weld seam, the bottom is formed as one piece from a wall of the terminal wherein the wall is bent towards the centre of the tubular terminal at its end to form the bottom.

8. Connection of claim 7, wherein the weld seam is a friction weld seam, a rotational friction weld seam, a resistance weld seam, a laser weld seam or an ultrasonic weld seam.

9. Connection of claim 7, wherein the face side of the cable is flush with one end of the support sleeve.

10. Connection of claim 7, wherein the cable consists of aluminum or an aluminum alloy, and in that the terminal consists of a conductive material, in particular copper or a copper alloy.

11. Connection of claim 7, wherein the cable has insulation removed in the area of the support sleeve.

12. Connection of an electrical cable consisting of a plurality of wires or strands to a terminal, in particular for the electrical system of a motor vehicle, said connection comprising:

a support sleeve which encloses an end area of the cable and serves to accommodate an end face of the cable, so that the wires or strands are held in the support sleeve, wherein the face side of the cable formed by the individual wires or strands is welded to the terminal by means of an at least face side weld seam, and the terminal is hollow on the side opposite the weld seam, wherein the terminal is formed from a flat part, and a circular extension is formed on one end of the flat part, this circular extension forming the bottom in the deformed state and in that the bottom is welded to the cable along the weld seam.

13. Connection of claim 12, wherein the weld seam is a friction weld seam, a rotational friction weld seam, a resistance weld seam, a laser weld seam or an ultrasonic weld seam.

14. Connection of claim 12, wherein the face side of the cable is flush with one end of the support sleeve.

15. Connection of claim 12, wherein the cable consists of aluminum or an aluminum alloy, and in that the terminal consists of a conductive material, in particular copper or a copper alloy.

16. Connection of claim 12, wherein the cable has insulation removed in the area of the support sleeve.

* * * * *